United States Patent [19]

Derbyshire et al.

[11] 4,440,622

[45] Apr. 3, 1984

[54] INTEGRATION OF SHORT-CONTACT-TIME LIQUEFACTION AND CRITICAL SOLVENT DEASHING WITH GASIFICATION THROUGH METHANOL-TO-GASOLINE

[75] Inventors: Francis J. Derbyshire, Ewing, N.J.; Philip Varghese, Newtown, Pa.; Darrell D. Whitehurst, Titusville, N.J.

[73] Assignee: Mobil Oil Corporation, New York, N.Y.

[21] Appl. No.: 391,280

[22] Filed: Jun. 23, 1982

[51] Int. Cl.[3] ..... C10G 1/00; C07C 1/00

[52] U.S. Cl. ..... 208/8 LE; 585/733; 585/640; 518/703

[58] Field of Search ..... 208/8 LE; 585/733, 640; 518/703

[56] References Cited

U.S. PATENT DOCUMENTS

| | | | |
|---|---|---|---|
| 3,507,777 | 4/1970 | Hemminger | 208/86 |
| 4,075,079 | 2/1978 | Long | 208/8 LE |
| 4,076,761 | 2/1978 | Chang et al. | 518/703 |
| 4,138,442 | 2/1979 | Chang et al. | 585/733 X |
| 4,159,237 | 6/1979 | Schmid | 208/8 LE |
| 4,191,700 | 3/1980 | Lebowitz et al. | 208/10 X |
| 4,222,845 | 9/1980 | Schmid | 208/10 X |
| 4,222,846 | 9/1980 | Schmid | 208/10 X |
| 4,331,529 | 5/1982 | Lambert et al. | 208/8 R |

OTHER PUBLICATIONS

"Critical Solvent Deashing of Liquefied Coal", Adams et al., Kerr-McGee Corp., OK City, OK, 1979 AICHE.

*Primary Examiner*—William G. Wright

*Attorney, Agent, or Firm*—Alexander J. McKillop; Michael G. Gilman; Charles J. Speciale

[57] ABSTRACT

Coal is processed by liquefying the coal with a hydrogen-donor solvent under a short-contact-time liquefaction, separating the coal liquid effluent into liquid phases of distinct polarity and an undissolved coal residue, upgrading a portion of the liquid phase, gasifying the residue and high polarity coal liquid to produce a synthesis gas which is used to form methanol. The methanol is catalytically converted to gasoline products. Solvents for liquefaction and effluent separation can be derived from the upgraded liquid phase, methanol and gasoline products. Hydrogen for liquefaction, methanol synthesis and upgrading is derived from the synthesis gas.

19 Claims, 1 Drawing Figure

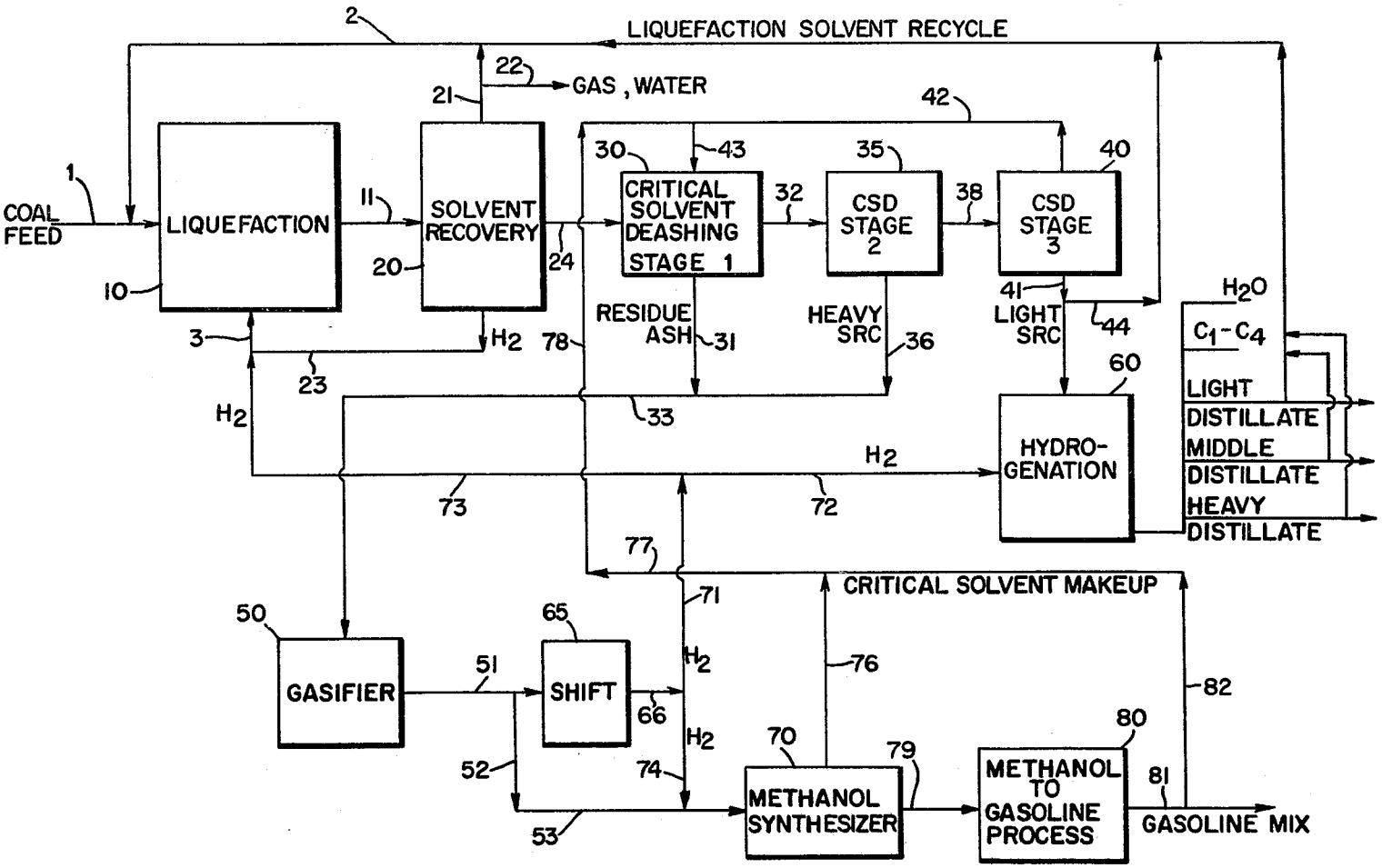
COAL FEED
LIQUEFACTION
SOLVENT RECOVERY
GAS, WATER
LIQUEFACTION SOLVENT RECYCLE
CRITICAL SOLVENT DEASHING STAGE 1
CSD STAGE 2
CSD STAGE 3
RESIDUE ASH
HEAVY SRC
LIGHT SRC
HYDRO-GENATION
$H_2O$
$C_1-C_4$
LIGHT DISTILLATE
MIDDLE DISTILLATE
HEAVY DISTILLATE
CRITICAL SOLVENT MAKEUP
GASIFIER
SHIFT
METHANOL SYNTHESIZER
METHANOL TO GASOLINE PROCESS
GASOLINE MIX
$H_2$

INTEGRATION OF SHORT-CONTACT-TIME LIQUEFACTION AND CRITICAL SOLVENT DEASHING WITH GASIFICATION THROUGH METHANOL-TO-GASOLINE

BACKGROUND OF THE INVENTION

1. Field of the Invention

This invention relates to processes for obtaining valuable fuel products from coal, and more particularly, relates to the integration of coal liquefaction and coal gasification so as to obtain a wide range of selected coal-derived fuel products. Specifically, the invention relates to the processing of coal or other solid fuel products in which coal liquefaction and coal gasification are combined with a methanol-to-gasoline conversion process to produce a wide product slate of fuels.

Coal is becoming an increasingly attractive source for gaseous and liquid fuel inasmuch as coal is available in abundant supply and can be liquefied by a variety of techniques to produce a range of gaseous, distillate and nondistillate coal products. It is recognized that the coal products derived from liquefying coal may be refined and furnish a substitute for petroleum-based fuels and/or petroleum-based feedstocks for the chemical industry.

It has also been well established that coal can be converted to gasoline by gasification of the coal and the subsequent production of methanol from the synthesis gas which is produced followed by the catalytic conversion of the methanol to gasoline. A ZSM-5 type zeolite catalyst has been found to be very effective in the conversion of methanol to gasoline. However, if a wide range of distillate products is desired from coal, the methanol-to-gasoline conversion process alone is not sufficient. Accordingly, a need exists to provide a wider product slate from coal than is ordinarily obtained from the methanol-to-gasoline conversion process. In accordance with the present invention, a wider product slate is obtained from coal by integrating the methanol-to-gasoline conversion process with coal liquefaction and coal gasification. A very flexible, material and energy efficient coal conversion process is provided which allows greater selectivity as to the fuel products derived.

2. Description of the Prior Art

Deriving a gaseous and liquid fuel from coal utilizing integrated coal liquefaction and coal gasification is known to the art. For example, an integrated process for deriving fuel from coal is disclosed in an article entitled "Development of A Process for The Supercritical Gas Extraction of Coal" by J. C. Whitehead, National Coal Board, Coal Research Establishment, Stoke-Orchard, Cheltenham, England, 1979. In the article is described a process for deriving fuels from coal which includes the supercritical gas extraction of coal in which the extraction process is based on the ability of compressed gas to dissolve significant quantities of a high molecular weight substrate. The coal extract can be further upgraded. The article reveals that a variety of process options, in terms of processing routes and product slates have been evaluated and that the majority of these options are based on the principle of generating power, process heat, and hydrogen from the residual solid char which remains after coal extraction. Any char excess to requirements in the schemes is converted to synthesis gas. Solvent make-up for the supercritical gas extraction can be obtained from the products of extract upgrading.

U.S. Pat. No. 4,191,700 issued Mar. 4, 1980 to Lebowitz et al, discloses a process for upgrading fuels, particularly coal, by means of integrating coal liquefaction and coal gasification with methanol synthesis. In this patent, coal is solvent refined with a conventional hydrogen donor solvent under severe conditions, preferably in a hydrogen environment, to convert substantially all the coal to a liquid product which is divided in a vacuum still separation zone into a light distillate product, recycle solvent, a heavy distillate, and a vacuum residue slurry. The vacuum residue slurry provides an efficient feed for a partial oxidation gasifier which produces synthetic gas as a feed for methanol and/or methane production and to supply hydrogen, as required, to the liquefier.

Although integrated coal liquefaction and coal gasification, as described above in the Whitehead article and Lebowitz et al patent, is known and is used to derive a wide slate of fuel products from coal efficiently and with increased product selection, the integrated coal liquefaction and gasification processes up to the present time have not fully utilized the synthesis gas products which are formed during coal gasification which follows coal liquefaction so as to further increase the production of high value fuel products and optimize the ability to select which products are to be obtained from the coal. As set forth in the integrated process as discussed above, the solid char which remains from the supercritical gas extraction in the Whitehead article is gasified to produce a synthesis gas while the vacuum residue slurry described in Lebowitz et al is separated from the liquefied coal and converted to methanol or methane. These end products are apparently used in the respective processes to provide heat for the process in which excess products will be sold for heating value.

U.S. Pat. Nos. 4,222,845 and 4,222,846 issued Sept. 16, 1980 to Schmid are typical of integrated coal liquefaction-gasification processes in which the synthesis gas which is formed is burned as fuel within the process so that the heat content is recovered via combustion. Any excess synthesis gas which cannot be utilized as fuel within the process is subjected to a methanation step or methanol conversion step to increase the heating value of the synthesis gas.

SUMMARY OF THE INVENTION

In accordance with the present invention, the methanol-to-gasoline conversion process is combined with coal liquefaction and coal gasification to produce a broader slate of coal-derived fuel products with increased product selectivity along with improved overall material consumption and energy efficiency than has heretofore been obtained. It has been found that by combining coal liquefaction and coal gasification through to the formation of methanol and the conversion of methanol to gasoline a very flexible operation is allowed whereby desired fuels from a wider coal-derived product slate can be obtained.

Briefly, the process comprises short-contact-time liquefaction of coal with a process-derived solvent, optionally in a hydrogen environment, to provide a substantially liquid coal product and subsequent separation of the coal product into a residue of undissolved coal and ash, a heavy, high polarity SRC and a light, low polarity SRC. The light SRC is a hydrogen-rich liquid coal product which is subjected to upgrading in the presence of hydrogen. The severity of the hydrogen upgrading can be adjusted to obtain the product range desired. Inasmuch as the light SRC is of low molecular weight and hydrogen-rich, less hydrogen is required for product upgrading than is needed when a full SRC is upgraded. The light SRC produced and separated in accordance with the present invention is more reactive, easier to upgrade and requires less hydrorefining to remove nitrogen, sulfur and oxide compounds than do full SRC products. Accordingly, there is a substantial savings in hydrogen consumption and energy requirements using the process of the present invention. The heavy SRC and residue stream of undissolved coal and ash are fed as a fluid or a molten slurry to an oxidation gasifier to produce a synthesis gas stream. The synthesis gas stream is used to generate hydrogen via the shift reaction in sufficient quantity to supply the hydrogen needed for liquefaction, light SRC upgrading, and adjustment of the $CO/H_2$ ratio of the synthesis gas for the formation of methanol. The methanol is then converted to gasoline by passing the methanol over a zeolite catalyst. The light SRC separated from the liquid coal product, as well as light, middle and heavy distillate fractions from upgrading the light SRC may be used as the solvent in the liquefaction of the coal feed.

Separation of the coal product into the solid and distinct liquid compositions can be achieved by filtration, solvent precipitation, vacuum distillation or critical solvent deashing of the coal product. Critical solvent deashing of the liquid coal product involves dissolving the liquid product by the use of a light solvent under supercritical conditions of temperature and pressure in which the dissolving power of the critical solvent is adjusted to separate the light SRC from the heavy SRC. The light solvent used as the solvent in the critical solvent deashing of the liquid coal product can be derived from gasoline components formed during upgrading of the light SRC, from gasoline formed from the methanol-to-gasoline conversion process, or from the methanol stream. Optionally, an external solvent may be used. The integrated coal liquefaction and gasification process of the present invention produces a wide variety of transport fuels and petrochemical feedstocks.

BRIEF DESCRIPTION OF THE DRAWING

The FIGURE is a diagrammatic view of the process according to the present invention.

DETAILED DESCRIPTION OF THE INVENTION

The process of the present invention is concerned with the efficient and economical production of a wide product slate from coal. It is contemplated that any suitable solid hydrocarbon fuel source can be used in this process. Examples are lignites, bituminous coal, and sub-bituminous coals.

In carrying out the process of the present invention, the coal feed is contacted with a solvent which is derived from the produced coal liquids, preferably under hydrogen, for a only a short contact time to dissolve a major portion of the coal. The coal product effluent undergoes a flash distillation to separate gas, water and light solvents from the effluent. The gas and water are removed, the hydrogen is separated for recycle and the solvent stream is recycled to the short-contact-time coal liquefier. The coal product effluent is transferred to a separation zone and divided into a residue of undissolved coal and ash and a coal liquid fraction. The coal liquid fraction is separated into a heavy (high polarity) SRC and a light (low polarity) SRC. The light SRC is then subjected to upgrading in the presence of hydrogen to produce gaseous fuel products as well as light, middle and heavy range distillate fractions. The light SRC, as well as any of the distillate fraction from upgrading the light SRC, may be used as the solvent for the short-contact-time liquefaction of the coal feed. The coal residue may be mixed with the heavy SRC. The mixture serves as a feedstock for an oxidation gasifier which produces synthesis gas. The synthesis gas is used as a feedstock for methanol production and for the supply of hydrogen required for light SRC upgrading and for hydrogen requirements during coal liquefaction. The methanol synthesizing zone produces methanol which is then converted to gasoline by passing the methanol over a zeolite catalyst. If the separation of the distinct coal liquid fractions is accomplished by critical solvent deashing, a portion of either the methanol, the gasoline produced via the methanol conversion, or light gasoline products from hydrocracking the light SRC or mixtures thereof can provide the solvent for this particular separation process.

In the first stage of the integrated process, the coal feed is liquefied by a process that can be characterized as short-contact-time (SCT) coal liquefaction in which the coal is contacted with a coal-derived solvent stream and hydrogen for a short time period. Generally, a fuel product source such as coal is dried, premixed with a solvent under ambient conditions (15°–25° C.) and reduced to particulate size by comminution. The premixing solvent comprises distillate product streams and preferably originates from various sources within the integrated system of the present invention. Additional solvent from other sources may be added to the recycle premixing solvent if necessary. It is understood that coal-derived solvents are not mandatory in the premixing stage although coal-derived solvents from the system are preferred to increase process efficiency. Any light aromatic stream is acceptable and need not be necessarily process derived. Petroleum-derived aromatics such as reformate streams or aromatic naphthas can be used as a make-up solvent when the solvent balance is difficult to achieve. In another mode of operation heavier distillates derived from coal may be added as co-solvents to increase coal conversions. Such solvents contain typical hydrogen donors such as tetralin, hydrophenanthrenes, hydropyrenes, hydroquinolines, hydroanthracenes, partially saturated biphenyls and the like. This co-solvent stream is regenerated in the latter hydrogenative stages of the process.

The resultant slurry is then fed to the SCT liquefaction zone wherein the slurry is brought into contact with a hydrogen donor solvent. The hydrogen donor solvent is preferably derived from the liquefied coal and is comprised primarily of partially hydrogenated aromatic hydrocarbons. Mixtures of hydrocarbons are generally employed, usually boiling in the range of about 400°–975° F. Examples of suitable solvent components are tetralin, methyltetralin, hydrophenanthene, etc. The solvent may be hydrogen treated prior to introduction into the SCT liquefaction zone to enhance the hydrogen donor capacity of the solvent.

The contact between the hydrogen donor solvent and the coal takes place within a temperature range of from about 750°–900° F. and preferably from about 750°–850° F., and at a pressure ranging from between about 0 to about 4,000 psig and preferably from about 1500 to about 2500 psig. The contact may optionally take place in a hydrogen atmosphere depending on the characteristics of the coal feed. Some coals, for example high volatile bituminous coals, do not require the presence of a hydrogen atmosphere for a liquefaction while others may. Under the operating conditions set forth, up to about 85% of the coal is dissolved very quickly and very little hydrogen is consumed. The presence of hydrogen gas in the early stages of conversion is not critical, but a good hydrogen donor solvent must be present. The dissolved coal is fairly rich in hydrogen. The appropriate quantity of coal is typically dissolved within three to six minutes. Continuing the process under the same operating conditions will further dissolve the coal feed, but the desired hydrogen content of the SRC fraction decreases due to the reactions which are taking place. Therefore, it is necessary to terminate the liquefaction process fairly quickly; generally within six minutes. The SCT coal liquefaction process used in the present invention is further described in an article entitled "Short-Contact-Time Coal Liquefaction", T. O. Mitchell and D. D. Whitehurst, ACS Division of Fuel Chemistry, reprints, page 127, San Francisco, August 1976.

The weight ratio of solvent to coal will generally be in the range of about 1–10:1, preferably 1–5:1, and particularly preferred 2–3:1.

The resulting effluent from SCT coal liquefaction comprises a mixture of light gases, water, a distillate solvent, a liquid coal product, undissolved coal and mineral matter. A conventional solvent recovery process such as flash or vacuum distillation, or the like may be performed in order to separate out the gaseous and solvent products from the liquid coal effluent. By employing conventional scrubbing techniques, the hydrogen can be purified free of the other gaseous components and recycled to the SCT liquefier.

The substantially liquid coal product effluent from the SCT liquefier is then transferred to a separation zone wherein the effluent is separated into a residue of undissolved coal, ash and mineral matter, as well as distinct light, low polarity and heavy, high polarity SRC products. The separation can be provided by filtration, solvent precipitation, vacuum distillation or a supercritical solvent extraction. The preferred embodiment for separating the residual coal products from the SRC product is characterized as "critical solvent deashing" which is a separation technique developed by Kerr-McGee Corporation and which is described in an article entitled "Critical Solvent Deashing of Liquefied Coal," R. M. Adams, A. H. Knebel, and D. E. Rhodes, CEP, Vol. 75, June 1979. Critical solvent deashing (CSD) is a solid-liquid separation technique developed to separate mineral matter and unreactive coal from coal liquids. The term "critical solvent" refers to any solvent under temperatures and pressures near the critical values for that solvent.

Three unique characteristics of the critical solvent which effect solid-liquid separation utilizing critical solvent deashing include: (1) the density of the critical solvent which changes rapidly with temperature; (2) the dissolving power of the critical solvent which changes roughly in proportion to its density; and (3) the dissolving power of the critical solvent which is greatest for "lighter" coal fractions and lowest for "heavier" liquid coal fractions.

Operation of critical solvent deashing within the integrated process of the present invention comprises mixing the solids-containing coal product effluent from the SCT coal liquefier and solvent flash separation stage with a deashing solvent. Preferably, the deashing solvent is a relatively low boiling gasoline solvent which can be process-derived. The mixture of the effluent and deashing solvent is carried to a first-stage settler wherein mineral matter and undissolved coal separate from the liquid products as a heavy fluid phase. The heavy fluid phase is removed from the bottom of the settler and stripped to recover entrained deashing solvent. A light phase consisting of coal liquids dissolved in deashing solvent, flows from the top to the first stage settler and is heated to decrease the density of the solvent. Inasmuch as the dissolving power of the critical solvent changes roughly in proportion to its density, the inverse solubility effect of the critical solvent causes the coal liquid products to be rejected from the deashing solvent as a heavy fluid phase. The two phases flow to a second stage settler, wherein the deashed coal liquid is withdrawn from the bottom of the settler and stripped to recover entrained deashing solvent. The barren deashing solvent from the top of the second stage settler and the deashing solvent recovered from the two separators can be recycled. Using critical solvent deashing, the coal liquid formed in the SCT coal liquefaction can be separated into any number of distinct liquid fractions. Accordingly, the second stage can be operated at a higher density that in the two-stage process set forth so that a portion of the coal liquid remains in solution in the deashing solvent flowing from the top of the second stage settler. The density of the deashing solvent can then be further decreased in a third-stage settler so as to result in the rejection of soluble coal products from the solvent as a heavy fluid phase which can be characterized as a light deashed SRC. Accordingly, by adjusting the solvent density in the settlers, the SRC formed in the short-contact time liquefier can be divided into a broad range of heavy and light deashed coal liquid fractions. The product split will depend on the relative solubility of the coal liquids in the deashing solvent, the lighter, low polarity components remaining in solution with the deashing solvent longer than the heavier, high polarity liquid components.

In the present invention, it is preferred to utilize three critical solvent deashing settling stages in which undissolved coal, mineral matter, and ash are separated in a first stage, a heavy, high polarity SRC is separated in a second stage and a light, low polarity SRC is separated in a third stage. The light SRC which is separated can be recycled and used as a SCT coal liquefaction solvent. The light SRC which is separated is a hydrogen-rich liquid coal product which contains a higher proportion of hydrogen than the original coal feed. Preferably, the hydrogen-rich light SRC which is separated has a hydrogen content comprising about 8% by weight. The light SRC is further characterized as containing less sulfur and nitrogen than the coal feed and is essentially free of mineral matter containing less than 0.20% ash.

The hydrogen-rich light SRC leaving the separation zone enters a hydrogenation zone wherein the light SRC is upgraded to produce a product slate comprising a small amount of water and ammonia, $C_1$–$C_4$ gaseous products, naphthas which are valuable for reforming gasolines, a good source of petrochemicals having about 95% naphthenes and aromatics which produce benzene, xylene, toluene, and preferably an acceptable process-derived critical solvent, and middle distillate products which can be processed to produce acceptable diesel and jet fuels. In addition, some higher boiling products will be formed. Preferably, the distillates can be divided into two fractions, the first fraction boiling between its initial boiling point and about 170° C. and a second fraction boiling between about 170°–300° C. The adjustment of the product slate which is obtained is extremely flexible and can be controlled by adjusting the dissolving power of the critical solvent in the CSD separation and the severity of the upgrading conditions. Accordingly, process conditions in each of the SCT liquefaction zone, CSD separation zone, and hydrogenater are important but can be varied over a wide range to produce the desired hydrocarbon products. An additional advantage of separating a hydrogen-rich material from the coal feed before hydrogenation is that the coal extract fed to the hydrogenater compared to the feed in most other coal liquefaction processes is richer in hydrogen and lower in molecular weight and metals content. Most probably, the light, hydrogen-rich SRC can be effectively treated by various catalysts without incurring inordinate deactivation rates.

The residue of undissolved carbon, mineral matter, and ash which is separated from the effluent of the SCT coal liquefier is mixed with any heavy SRC which has been separated by any of the conventional separation techniques, including the preferred critical solvent deashing. The formed mixture is employed as a feedstock for an oxidation gasifier. The solid undissolved coal and ash remains as reactive as the feed coal and has a calorific content similar to that of the feed source. Unlike normal pyrolitic techniques which generate a char residue with little volatile matter, the residue which remains after liquefaction and separation as discussed above retains much of the volatile content of the feed source. The mixture of residue and heavy SRC is passed to the gasifier as a fluid slurry or as a molten slurry if previous separation has yielded an easily melted heavy SRC. Gasifiers which produce synthetic gas are known to the art and include Koppers-Totzek, Shell, Texaco, and Lurgi. A Texaco gasifier which can accept the residue and heavy SRC mixture in a molten state is preferred. Inasmuch as gasifiers have been described extensively in the patent literature, only a brief description of gasification to form a synthesis gas needs to be provided.

The residue and heavy SRC mixture is fed to the oxidation gasifier and reacted with oxygen and steam in a closed reaction zone at an oxidation temperature within the range of about 1800° F. to 3000° F., usually about 2200° F. to 2800° F. The reactor zone pressure is generally about 300–1000 psig, although higher pressures are possible. The products from the gasifier are principally carbon monoxide and hydrogen and include small amounts of carbon dioxide, methane and entrained carbon. The entrained carbon may be removed by conventional methods and recycled to the gasifier. The gas stream is then transferred to a methanol synthesizer.

In the conversion of the synthesis gas to methanol it is preferred to adjust the hydrogen to carbon monoxide mole ratio to about 3:1. The gas stream can then be contacted with a catalyst to form methanol. The well known water-gas shift reaction may be used to increase the hydrogen/carbon monoxide ratio. In the shift process the synthesis gas is contacted with water under conditions where carbon monoxide reacts with the water to produce hydrogen and carbon dioxide. The hydrogen-rich stream is then split, one portion being directed to the hydrogenater to supply hydrogen to meet the reaction requirements of upgrading the light SRC which has been separated from the liquefier effluent, another portion being directed to the SCT coal liquefier to supply needed hydrogen. The remaining portion is combined with the gasifier effluent to provide at least the stoichiometric requirements for methanol synthesis. An excellent summary of the art of gas manufacture, including synthesis gas, from solid and liquid fuels is presented in the Encyclopedia of Chemical Technology, edited by Kirk-Othmer, second edition, Vol. 10, pp. 353–433 (1966), Interscience Publishers, New York, N.Y.

For the purposes of this invention, methanol is synthesized in any conventional manner known to the art. For example, the synthesis gas can be converted to methanol by passing the gas over a catalyst such as a catalyst which comprises zinc/copper. The process operates at about 350°–600° F. and 700–2500 psig. Thermodynamic equilibria dictate operating at incomplete conversion with a synthesis gas recycle ratio of about 4–10.

A portion of the methanol stream leaving the methanol synthesizer can be used as a make-up solvent for the critical solvent deashing separation.

A larger portion of the methanol product leaving the methanol synthesizer is converted to gasoline by any conventional methanol-to-gasoline conversion process. Briefly, the methanol is contacted with a zeolite catalyst, such as ZSM-5 to produce a narrow range high octane gasoline containing $C_4$–$C_{12}$ hydrocarbons. Typically the methanol is converted to aromatic gasoline over the zeolite catalyst as defined above, at about 500° to about 1200° F. and about 0.5 to 50 LHSV. U.S. Pat. Nos. 3,928,483 and 4,049,734 disclose processes of converting synthesis gas to methanol and methanol to gasoline and are herein incorporated by reference.

The gasoline fraction leaving the methanol-to-gasoline conversion zone is also an ideal internally derived solvent for use in the critical solvent deashing separation zone. More importantly, the gasoline product which is derived broadens the product slate which is obtained from the overall integrated coal liquefaction and coal gasification system.

For further understanding of the invention, the drawing will now be considered.

Coal feed and premixed solvent are mixed and passed through line 1 to the short-contact-time liquefaction zone 10 whereupon the coal slurry is brought into contact with solvent to quickly dissolve the coal solids. Preferably, the solvent is process-derived. Coal liquefaction proceeds until about 85% of the coal has been dissolved. As stated previously, it is important that coal liquefaction terminate before the hydrogen content of the liquid coal product decrease due to process conditions. The resulting effluent of SCT coal liquefaction which comprises a mixture of light gases, water, distillate solvent, SRC, as well as undissolved coal and mineral matter is passed via line 11 to solvent recovery zone 20 whereupon the solvent is recovered by a flash or other distillation process. The solvent is then recycled to line 1 via lines 21 and 2. In addition, $CO_2$, CO and $H_2O$ are removed from the effluent and leave recovery zone 20 through lines 21 and 22. The remaining hydrogen can be stripped from the gases and is recycled to the liquefaction zone 10 via lines 23 and 3.

The remaining coal product effluent passes via line 24 to a separation zone which for the purposes of description is illustrated as a critical solvent deashing process. Accordingly, the mixture of undissolved coal and ash and SRC enters the first stage settler 30 via line 24. In the settler 30, the effluent from solvent recovery zone 20 is mixed with a light, deashing solvent under supercritical conditions of temperature and pressure for that solvent. A residue of undissolved coal, mineral matter, and ash separates out from the dissolved coal liquids and is removed from first stage settler 30 via line 31 whereupon further deashing solvent may be separated from the residue. Leaving first stage settler 30 via line 32 is an effluent comprising critical solvent having dissolved therein a mixture of heavy and light SRC. The density of the effluent leaving the first stage settler is adjusted, such as by increasing the temperature so that in second stage settler 35, a heavy SRC is precipitated from the solution of critical solvent and lighter SRC. The heavy SRC leaves the second stage settler 35 via line 36 where, again, deashing solvent may be separated from the SRC stream. The effluent leaving second stage settler 35 enters a third stage settler 40 via line 38 whereupon the density of the critical solvent is again adjusted so as to precipitate the remaining light SRC from the critical solvent. The light SRC is removed from third stage settler 40 via line 41. The barren critical solvent leaves third stage settler 40 and can be recycled to first stage settler 30 via lines 42 and 43.

A portion of the light SRC leaving third stage settler 40 can be recycled to the SCT liquefaction zone via lines 44 and 2. The remaining hydrogen-rich light SRC leaves third stage settler 40 via line 41 and enters hydrogenation zone 60. Upon upgrading in the presence of hydrogen, the hydrogen-rich light SRC is processed into a light gas stream and distillate products ranging from light naphtha to a middle range distillate product which can be processed into an acceptable diesel and jet fuel. In addition, some lighter boiling products will be formed. A portion of the middle distillate and higher boiling products may be recycled to the SCT liquefaction zone via line 2. A portion of the light distillate fraction may be recycled as solvent for use in the critical solvent deashing separation process.

The residue which leaves the first stage settler 30 and the heavy SRC from second stage settler 35 are treated to remove the deashing solvent and mixed and passed via line 33 to gasification zone 50 in a fluid or molten state. In gasification zone 50 the mixture is reacted with steam and oxygen to produce a synthesis gas consisting principally of carbon monoxide, hydrogen, and acid impurities ($CO_2$, $H_2S$, COS). The acid gas impurities can be removed by conventional methods. A portion of the synthesis gas produced in gasifier zone 50 is transported via lines 51, 52 and 53 to the methanol synthesis zone 70. The remaining portion of the synthesis gas is shifted to form relatively pure hydrogen in shift reactor 65. After conventional steps are taken to clean the hydrogen stream which leaves shift reactor 65 via line 66, the hydrogen stream is split. A portion of the hydrogen effluent flows directly to hydrogenator 60 via lines 71 and 72 to supply the hydrogen requirements therein. Another portion of the hydrogen is directed to the SCT liquefaction zone 10 via lines 71, 73 and 3. The remaining hydrogen is taken via line 74 and mixed with the synthesis gas in line 53 to provide the proper mole ratio of $H_2/CO$ to form methanol in methanol synthesizer 70. A portion of the methanol produced leaves methanol synthesizer 70 via line 76 and can be directed to the critical solvent deashing separation zone via lines 77, 78 and 43 and can be used alone or in admixture with other process-derived solvents for use in the critical solvent deashing and separation of the effluent leaving liquefaction zone 10.

A portion of all of the methanol product leaves methanol synthesizer 70 via line 79 and enters methanol-to-gasoline conversion zone 80. In this particular reaction zone, the methanol is contacted with a zeolite catalyst to produce a relatively narrow range of high octane gasolines. The gasoline fraction exits through line 81 as a gasoline product or, alternatively, a portion may be recycled through lines 82, 77 and 43 to the critical solvent deashing separation zone as a process-derived solvent, either alone or in admixture with the other process-derived solvents. This gasoline fraction is an ideal solvent for use in the critical solvent deashing of the liquefied coal.

In the above description, it should be understood that the key process steps have been described in their concept and that one skilled in the engineering design of process plants would recognize engineering alternatives for carrying out the same process steps. In particular, it would be important to the overall economics of the process to efficiently recover energy (heat) from streams being cooled and to utilize this energy to offset other process requirements. The particular choice of such items would be apparent to one skilled in the art.

In the process of the present invention, coal is transformed into a number of high quality fuels and chemicals by means of an economical and efficient integrated process. Rather than forming a synthesis gas directly from the coal and forming methanol and then gasoline from the methanol to yield a high octane gasoline, the present process forms from the coal a light, hydrogen-rich SRC which yields valuable distillate fractions which with the gasoline produced in the methanol conversion process yields a wide slate of fuel and petrochemical products. At present, there is a conscious desire to conserve and use to the utmost efficiency world petroleum feedstocks. This has resulted in vast changes in the types of petrofuels which are utilized. The increased shift to diesel fuel is such an example. Accordingly, the wide product slate produced by the present invention is an improvement over converting all the coal to gasoline via the methanol-to-gasoline process or even over the prior art wherein not all of the remaining coal residue and heavy solvent-refined coal was converted to high valuable fuels but was used instead to supply only heat within the process. In addition, the process of the present invention provides hydrogen for the upgrading of the light SRC and for the short time coal liquefaction. Additionally still, the solvent used to liquefy the coal and in the critical solvent deashing separation process can be derived entirely from within the process if desired.

There are several other advantages of incorporating the methanol-to-gasoline conversion process within an integrated coal liquefaction and gasification process. The combination of the various fuel yielding processes imparts a greater overall efficiency than can be achieved by using any single process alone for producing fuel products. As discussed above, the product slate which is obtained is much wider. Furthermore, the calculated thermal efficiency of the integrated process of the present invention is greater than the calculated efficiency of the coal-methanol-gasoline process alone or of SCT coal liquifaction alone when calculated on a comparable basis. A major portion of the overall savings and efficiency results from the greater efficiency of hydrogen use, as well as the recycling of process-derived solvents.

For purposes of illustration, the following example demonstrates the product streams which are obtained by operation of the present invention.

EXAMPLE

Coal from the Wyodak Mine, located in Campbell County, Wyoming was treated according to the process described above. The basic is 100 weight units of moisture and ash-free Wyodak coal fed to the liquefaction reactor. Properties of the feed and effluent streams are shown in Tables 1, 2 and 3.

TABLE 1

| | Analysis of Streams | | | |
|---|---|---|---|---|
| | Coal | Residue | Heavy SRC | Light SRC |
| MAF Basis | | | | |
| C | 72.3 | 75.0 | 76.3 | 86.9 |
| H | 5.6 | 4.5 | 5.6 | 7.9 |
| O | 20.3 | 19.0 | 16.7 | 3.6 |
| N | 1.2 | 2.1 | 1.0 | 1.3 |
| S | 0.4 | 0.8 | 0.4 | 0.2 |
| % Moisture | 16.0 | — | — | — |
| % Ash | 6.3 | 16.5 | — | — |
| Calorific Value BTU/MAF lb. | 12848 | 12776 | 13612 | 16961 |

TABLE 2

| Flash Products From SCT-Liquefaction | | |
|---|---|---|
| | Wt. % | % of Coal |
| GAS | | |
| CO | 8.8 | .6 |
| $CO_2$ | 56.5 | 3.6 |
| $CH_4$ | 13.0 | .8 |
| $C_2$-$C_5$ | 8.1 | .5 |
| LIQUID | | |
| $C_6$-257° F. | 2.3 | .1 |
| 257-650° F. | 12.0 | .8 |

TABLE 3

| Effluent Streams (Basis 100 wt. Units Coal Feed) | |
|---|---|
| Flash Distillation of Liquefaction Effluent | |
| Gas | 5.4 Units |
| Water | 21.0 Units |
| Residue from CSD (Stage 1) | 40.0 Units |
| Ash from CSD (Stage 1) | 7.3 Units |
| Heavy SRC from CSD (Stage 2) | 23.8 Units |
| Light SRC from CSD (Stage 3) | 25.0 Units |
| Liquid Fuels from Hydrotreating | 24.3 Units |
| Gasoline Mix from Methanol-to-Gasoline | 21.0 Units |
| $H_2$ from Shift to HydroTreater | 1.6 Units |
| $H_2$ from Shift to Liquefaction | 0.7 Units |

What is claimed is:

1. An integrated process for the conversion of solid coal to a wide slate of fuel products comprising: liquefying a portion of said coal by contacting said coal with a solvent to product dissolved coal liquids and an undissolved coal residue, separating a light SRC from said coal liquids by mixing said coal liquids with a light solvent under supercritical conditions of temperature and pressure, whereby said light solvent is converted to a dense-gas phase capable of dissolving said coal liquid, and varying the density of said dense-gas phase to precipitate out said light SRC, said light SRC having a hydrogen concentration greater than said coal feed and remaining portions of said coal liquid, upgrading said light SRC in the presence of hydrogen to produce a plurality of upgraded fuel products, gasifying a mixture of said residue and a portion of said coal liquids under oxidizing conditions to produce a synthesis gas comprising hydrogen and carbon monoxide, shifting the hydrogen to carbon monoxide ratio of said synthesis gas to produce a hydrogen gas stream, combining a portion of said hydrogen gas stream with said synthesis gas, converting said combined hydrogen gas stream and synthesis gas to methanol, passing at least a portion of said methanol in contact with a catalyst capable of converting said methanol to gasoline products, recycling at least one of the product streams for use in the integrated process, said recycle product streams including methanol or said gasoline products for use as said light solvent, light SRC or upgraded fuel products as said solvent for liquefying said coal, or said hydrogen gas stream to upgrade said light SRC or for inclusion with said solvent to liquefy said coal.

2. The process of claim 1 wherein said coal comprises lignites, bituminous coals or sub-bituminous coals.

3. The process of claim 1 wherein said solvent is process-derived, derived from an external source, or mixtures thereof.

4. The process of claim 3 wherein said process-derived solvent is selected from the group consisting of solvent derived from said upgraded fuel products, solvent derived from a portion of said coal liquids, and mixtures thereof.

5. The process of claim 3 wherein said solvent comprises a hydrogen donor solvent.

6. The process of claim 5 wherein said coal is liquefied in the presence of hydrogen gas.

7. The process of claim 1 wherein said light SRC is upgraded in the presence of hydrogen and said hydrogen is provided from a portion of said hydrogen gas stream.

8. The process of claim 1 wherein said coal is liquefied in the presence of hydrogen and said hydrogen is provided from a portion of said hydrogen gas stream.

9. The process of claim 1 wherein a heavy SRC of generally higher molecular weight and higher polarity than said light SRC is separated from said coal liquid prior to separation of said light SRC from said coal liquid.

10. The process of claim 9 wherein a mixture of said residue and said heavy SCR is gasified under oxidizing conditions.

11. The process of claim 9 wherein the hydrogen supplied for upgrading is provided from said hydrogen gas stream.

12. The process of claim 5 wherein said coal is maintained in contact with said solvent no greater than about six minutes.

13. The process of claim 12 wherein said contacting takes place at a temperature from about 750°-900° F.

14. The process of claim 1 wherein said feed coal is dried, premixed with a premixing solvent and comminuted before being liquefied.

15. The process of claim 14 wherein said premixing solvent comprises distillate or non-distillate product oils.

16. The process of claim 15 wherein said premixing solvent is process-derived.

17. The process of claim 16 wherein said premixing solvent is a petroleum product.

18. The process of claim 1 wherein said light solvent is process-derived, derived from external sources, or mixtures thereof.

19. The process of claim 18 wherein said process-derived light solvent is selected from the group consisting of said upgraded fuel products, said methanol, said gasoline products and mixtures thereof.

* * * * *